US006029128A

United States Patent [19]

Jarvinen et al.

[11] Patent Number: 6,029,128

[45] Date of Patent: Feb. 22, 2000

[54] SPEECH SYNTHESIZER

[75] Inventors: Kari Jarvinen; Tero Honkanen, both of Tampere, Finland

[73] Assignee: Nokia Mobile Phones Ltd., Salo, Finland

[21] Appl. No.: 08/662,991

[22] Filed: Jun. 13, 1996

[30] Foreign Application Priority Data

Jun. 16, 1995 [GB] United Kingdom ..... 9512284

[51] Int. Cl.[7] ..... G10L 3/02

[52] U.S. Cl. ..... 704/220; 704/264

[58] Field of Search ..... 704/264, 207, 704/210, 222, 224, 262; 395/216, 217, 229, 273, 231, 271

[56] References Cited

U.S. PATENT DOCUMENTS

| | | | |
|---|---|---|---|
| 4,815,135 | 3/1989 | Taguchi | 381/37 |
| 4,969,192 | 11/1990 | Chen et al. | 381/31 |
| 5,241,650 | 8/1993 | Gerson et al. | 395/2 |
| 5,247,357 | 9/1993 | Israelsen | 358/133 |
| 5,444,816 | 8/1995 | Adoul et al. | 395/2.28 |
| 5,483,668 | 1/1996 | Malkamaki et al. | 455/33.2 |
| 5,506,934 | 4/1996 | Kawama | 395/267 |
| 5,651,091 | 7/1997 | Chen | 395/2.32 |
| 5,664,055 | 9/1997 | Kroon | 704/223 |

FOREIGN PATENT DOCUMENTS

| | | |
|---|---|---|
| 0 030 390A1 | 6/1981 | European Pat. Off. . |
| 0 333 425A2 | 9/1989 | European Pat. Off. . |
| 0 459 358A2 | 12/1991 | European Pat. Off. . |
| WO 91/06091 | 5/1991 | WIPO . |

*Primary Examiner*—David R. Hudspeth
*Assistant Examiner*—Scott Richardson
*Attorney, Agent, or Firm*—Perman & Green, LLP

[57] ABSTRACT

A post-processor 317 and method substantially for enhancing synthesised speech is disclosed. The post-processor 317 operates on a signal ex(n) derived from an excitation generator 211 typically comprising a fixed code book 203 and an adaptive code book 204, the signal ex(n) being formed from the addition of scaled outputs from the fixed code book 203 and adaptive code book 204. The post-processor operates on ex(n) by adding to it a scaled signal pv(n) derived from the adaptive code book 204. A gain or scale factor p is determined by the speech coefficients input to the excitation generator 211. The combined signal ex(n)+pv(n) is normalised by unit 316 and input to an LPC or speech synthesis filter 208, prior to being input to an audio processing unit 209.

12 Claims, 7 Drawing Sheets

SPEECH SYNTHESIZER

FIELD OF INVENTION

The present invention relates to an audio or speech synthesiser for use with compressed digitally encoded audio or speech signals. In particular, to a post-processor for processing signals derived from an excitation code book and adaptive code book of a LPC type speech decoder.

BACKGROUND TO INVENTION

In digital radio telephone systems the information, i.e. speech, is digitally encoded prior to being transmitted over the air. The encoded speech is then decoded at the receiver. First, an analogue speech signal is digitally encoded using Pulse Code Modulation (PCM) for example. Then speech coding and decoding of the PCM speech (or original speech) is implemented by speech coders and decoders. Due to the increase in use of radio telephone systems the radio spectrum available for such systems is becoming crowded. In order to make the best possible use of the available radio spectrum, radio telephone systems utilise speech coding techniques which require low numbers of bits to encode the speech in order to reduce the bandwidth required for the transmission. Efforts are continually being made to reduce the number of bits required for speech coding to further reduce the bandwidth required for speech transmission.

A known speech coding/decoding method is based on linear predictive coding (LPC) techniques, and utilises analysis-by-synthesis excitation coding. In an encoder utilising such a method, a speech sample is first analysed to derive parameters which represent characteristics such as wave form information (LPC) of the speech sample. These parameters are used as inputs to short-term synthesis filter. The short-term synthesis filter is excited by signals which are derived from a code book of signals. The excitation signals may be random, e.g. a stochastic code book, or may be adaptive or specifically optimised for use in speech coding. Typically, the code book comprises two parts, a fixed code book and the adaptive code book. The excitation outputs of respective code books are combined and the total excitation input to the short term synthesis filter. Each total excitation signal is filtered and the result compared with the original speech sample (PCM coded) to derive an "error" or difference between the synthesised speech sample and the original speech sample. The total excitation which results in the lowest error is selected as the excitation for representing the speech sample. The code book indices, or addresses, of the location of respective partial optimal excitation signals in the fixed and adaptive code book are transmitted to a receiver, together with the LPC parameters or coefficients. A composite code book identical to that at the transmitter is also located at the receiver, and the transmitted code book indices and parameters are used to generate the appropriate total excitation signal from the receiver's code book. This total excitation signal is then fed to a short-term synthesis filter identical to that in the transmitter, and having the transmitted LPC coefficients as respective inputs. The output from the short-term synthesis filter is a synthesised speech frame which is the same as that generated in the transmitter by the analysis-by-synthesis method.

Due to the nature of digital coding, although the synthesised speech is objectively accurate it sounds artificial. Also, degradations, distortions and artifacts are introduced into the synthesised speech due to quantisation effects and other anomalies due to the electronic processing. Such artifacts particularly occur in low bit-rate coding since there is insufficient information to reproduce the original speech signal exactly. Hence there have been attempts to improve the perceptual quality of synthesised speech. This has been attempted by the use of post-filters which operate on the synthesised speech sample to enhance its perceived quality. Known post-filters are located at the output of the decoder and process the synthesised speech signal to emphasise or attenuate what are generally considered to be the most important frequency regions in speech. The importance of respective regions of speech frequencies has been analysed primarily using subjective tests on the quality of the resulting speech signal to the human ear. Speech can be split into two basic parts, the spectral envelope (formant structure) or the spectral harmonic structure (line structure), and typically post-filtering emphasises one or other, or both of these parts of a speech signal. The filter coefficients of the post-filter are adapted depending on the characteristics of the speech signal to match the speech sounds. A filter emphasising or attenuating the harmonic structure is typically referred to as a long-term, or pitch or long delay post filter, and a filter emphasising the spectral envelope structure is typically referred to as a short delay post filter or short-term post filter.

A further known filtering technique for improving the perceptual quality of synthesised speech is disclosed in International Patent Application WO 91/06091. A pitch prefilter is disclosed in WO 91/06091 comprising a pitch enhancement filter, normally disposed at a position after a speech synthesis or LPC filter, moved to a position before the speech synthesis or LPC filter where it filters pitch information contained in the excitation signals input to the speech synthesis or LPC filter.

However, there is still a desire to produce synthesised speech which has even better perceptual quality.

SUMMARY OF INVENTION

According to a first aspect of the present invention there is provided a synthesiser for speech synthesis, comprising a post-processing means for operating on a first signal including speech periodicity information and derived from an excitation source, wherein the post-processing means is adapted to modify the speech periodicity information content of the first signal in accordance with a second signal derivable from the excitation source.

According to a second aspect of the present invention there is provided a method for enhancing synthesised speech, comprising deriving a first signal including speech periodicity information from an excitation source, deriving a second signal from the excitation source and modifying the speech periodicity information content of the first signal in accordance with the second signal.

An advantage of the present invention is that the first signal is modified by a second signal originating from the same source as the first signal, and thus no additional sources of distortion or artifacts such as extra filters are introduced. Only the signals generated in the excitation source are utilised. The relative contributions of the signals inherent to the excitation generator in a speech synthesiser are being modified, with no artificial added signals, to re-scale the synthesiser signals.

Good speech enhancement may be obtained if post-processing of the excitation is based on modifying the relative contributions of the excitation components derived within the excitation generator of the speech synthesiser itself.

Processing the excitation by filtering the total excitation ex(n) without considering or modifying the relative contributions of the signals inherent to the excitation generator, i.e. v(n) and $c_i(n)$ typically does not give the best possible enhancement. Modifying the first signal in accordance with the second signal from the same excitation source increases waveform continuity within the excitation and in the resulting synthesised speech signal, thereby improving its perceptual quality.

In a preferred embodiment the excitation source comprises a fixed code book and an adaptive code book, the first signal being derivable from a combination of first and second partial excitation signals respectively selectable from the fixed and adaptive code books, which is a particularly convenient excitation source for a speech synthesiser.

Preferably, there is a gain element for scaling the second signal in accordance with a scaling factor (p) derivable from pitch information associated with the first signal from the excitation source, which has the advantage that the first signal speech periodicity information content is modified which has greater effect on perceived speech quality than other modifications.

Suitably, the scaling factor (p) is derivable from an adaptive code book scaling factor (b), and the scaling factor (p) is derivable in accordance with the following equation, $$\text{if}\quad \begin{array}{ll} b < TH_{low} & \text{then } p = 0.0 \\ TH_{low} \le b < TH_2 & \text{then } p = a_{enh1} f_1(b) \\ TH_2 \le b < TH_3 & \text{then } p = a_{enh2} f_2(b) \\ \vdots & \vdots \\ TH_{N-1} \le b \le TH_{upper} & \text{then } p = a_{enhN-1} f_{N-1}(b) \\ b > TH_{upper} & \text{then } p = a_{enhN} f_N(b) \end{array}$$

where TH represents threshold values, b is the adaptive code book gain factor, p is the post-processor means scale factor, $a_{enh}$ is a linear scaler and f(b) is a function of gain b In a specific embodiment the scaling factor (p) is derivable in accordance with $$\text{if}\quad \begin{array}{ll} b < TH_{low} & \text{then } p = 0.0 \\ TH_{low} \le b \le TH_{upper} & \text{then } p = a_{enh} b^2 \\ b > TH_{upper} & \text{then } p = a_{enh} b \end{array}$$

where $a_{enh}$ is a constant that controls the strength of the enhancement operation, b is adaptive code book gain, TH are threshold values and p is the post-processor scale factor which utilises the insight that speech enhancement is most effective for voiced speech where b typically has a high value, whereas for unvoiced sounds where b has a low value a not so strong enhancement is required.

The second signal may originate from the adaptive code book, and may also be substantially the same as the second partial excitation signal. Alternatively, the second signal may originate from the fixed code book, and may also be substantially the same as the first partial excitation signal.

For the second signal originating from the fixed code book, the gain control means is adapted to scale the second signal in accordance with a second scaling factor (p')

where, $$p' = -\frac{gp}{(p+b)}$$

and g is a fixed code book scaling factor, b is an adaptive code book scaling factor and p is the first scaling factor.

The first signal may be a first excitation signal suitable for inputting to a speech synthesis filter, and the second signal may be a second excitation signal suitable for inputting to a speech synthesis filter. The second excitation signal may be substantially the same as the second partial excitation signal.

Optionally, the first signal may be a first synthesised speech signal output from a first speech synthesis filter and derivable from the first excitation signal, and the second signal may be the output from a second speech synthesis filter and derivable from the second excitation signal. An advantage of this is that speech enhancement is carried out on the actual synthesised speech and thus there are less electronic components to introduce distortion to the signal before it is rendered audible.

Advantageously, there is provided an adaptive energy control means adapted to scale a modified first signal in accordance with the following relationship, $$k = \sqrt{\frac{\sum_{n=0}^{N-1} ex^2(n)}{\sum_{n=0}^{N-1} ew'^2(n)}}$$

where N is a suitably chosen adaption period, ex(n) is the first signal, ew'(n) is the modified first signal and k is an energy scale factor, which normalises the resulting enhanced signal to the power input to the speech synthesiser.

In a third aspect according to the invention there is provided, a radio device, comprising a radio frequency means for receiving a radio signal and recovering coded information included in the radio signal, and an excitation source coupled to the radio frequency means for generating a first signal including speech periodicity information in accordance with the coded information, wherein the radio device further comprises a post-processing means operably coupled to the excitation source to receive the first signal and adapted to modify the speech periodicity information content of the first signal in accordance with a second signal derived from the excitation source and a speech synthesis filter coupled to receive the modified first signal from the post-processing means and for generating synthesised speech in response thereto.

In a fourth aspect of the invention there is provided a synthesiser for speech synthesis, comprising first and second excitation sources for respectively generating first and second excitation signals, and modifying means for modifying the first excitation signal In accordance with a scaling factor derivable from pitch information associated with the first excitation signal.

In a fifth aspect of the invention there is provided a synthesiser for speech synthesis, comprising first and second excitation sources for respectively generating first and second excitation signals, and modifying means for modifying the second excitation signal in accordance with a scaling factor derivable from pitch information associated with the first excitation signal.

The fourth and fifth aspects of the invention advantageously integrate scaling of excitation signals within the excitation generator itself.

DETAILED DESCRIPTION OF THE EMBODIMENTS OF THE INVENTION

Embodiments in accordance with the Invention will now be described, by way of example only, and with reference to the accompanying drawings.

Figure 1:
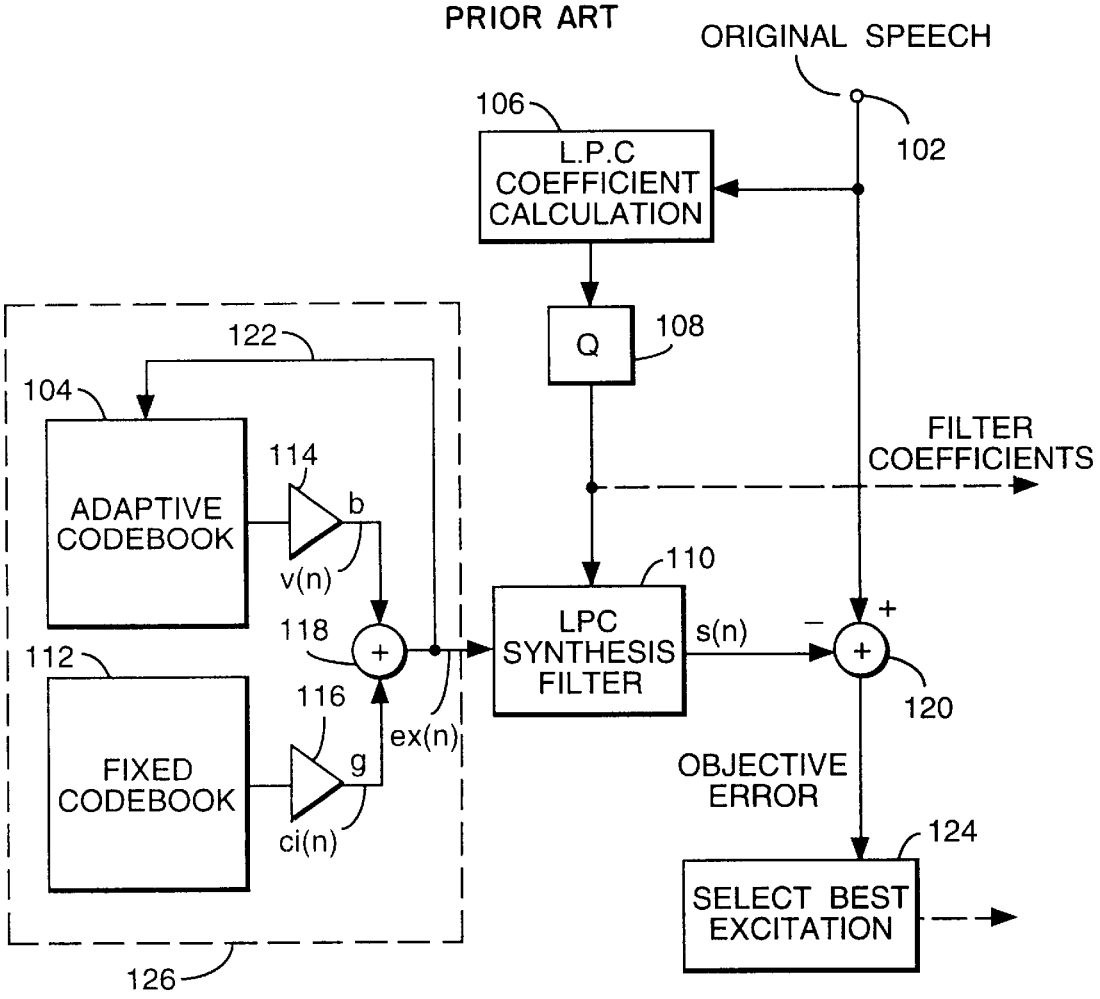
Fig.1. PRIOR ART
FIG. 1 shows a schematic diagram of a known Code Excitation Linear Prediction (CELP) encoder.

A known CELP encoder 100 is shown in FIG. 1. Original speech signals are input to the encoder at 102 and Long Term Prediction (LTP) coefficients T,b are determined using adaptive code book 104. The LTP prediction coefficients are determined for segments of speech typically comprising 40 samples and are 5 ms in length. The LTP coefficients relate to periodic characteristics of the original speech. This includes any periodicity in the original speech and not just to periodicity which corresponds to the pitch of the original speech due to vibrations in the vocal cords of a person uttering the original speech.

Long Term Prediction is performed using adaptive code book 104 and gain element 114, which comprise a part of excitation signal (ex(n)) generator 126 shown dotted in FIG. 1. Previous excitation signals ex(n) are stored in the adaptive code book 104 by virtue of feedback loop 122. During the LTP process the adaptive code book is searched by varying an address T, known as a delay or lag, pointing to previous excitation signals ex(n). These signals are sequentially output and amplified at gain element 114 with a scaling factor b to form signals v(n) prior to being added at 118 to an excitation signal $c_i(n)$ derived from the fixed code book 112 and scaled by a factor g at gain element 116. Linear Prediction Coefficients (LPC) for the speech sample are calculated at 106. The LPC coefficients are then quantised at 108. The quantised LPC coefficients are then available for transmission over the air and to be input to short term filter 110. The LPC coefficients (r(i), i=1 . . . , m where m is prediction order) are calculated for segments of speech comprising 160 samples over 20 ms. All further processing is typically performed in segments of 40 samples, that is to say an excitation frame length of 5 ms. The LPC coefficients relate to the spectral envelope of the original speech signal.

Excitation generator 126 effectively comprises a composite code book 104, 112 comprising sets of codes for exciting short term synthesis filter 110. The codes comprise sequences of voltage amplitudes, each corresponding to a speech sample in the speech frame.

Each total excitation signal ex(n) is input to short term or LPC synthesis filter 110 to form a synthesised speech sample s(n). The synthesised speech sample s(n) is input to a negative input of adder 120, having an original speech sample as a positive input. The adder 120 outputs the difference between the original speech sample and the synthesised speech sample, this difference being known as an objective error. The objective error is input to a best excitation selection element 124, which selects the total excitation ex(n) resulting in a synthesised speech frame s(n) having the least objective error. During the selection the objective error is typically further spectrally weighted to emphasise those spectral regions of the speech signal important for human perception. The respective adaptive and fixed code book parameters (gain b and delay T, and gain g and index i) giving the best excitation signal ex(n) are then transmitted, together with the LPC filter coefficients r(i), to a receiver to be used in synthesising the speech frame to reconstruct the original speech signal.

Figure 2:
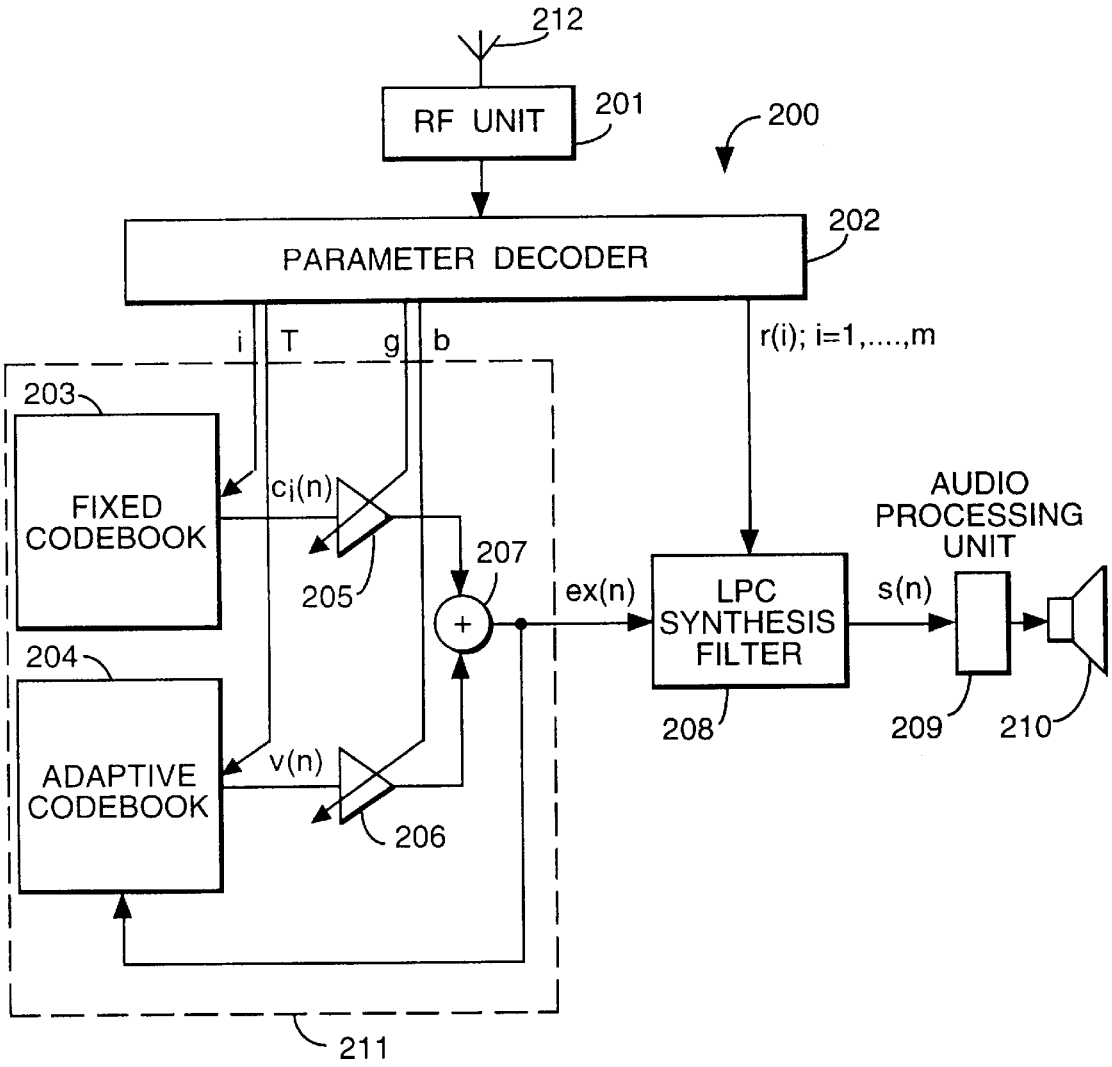
Fig.2. PRIOR ART
FIG. 2 shows a schematic diagram of a known CELP decoder.

A decoder suitable for decoding speech parameters generated by an encoder as described with reference to FIG. 1 is shown in FIG. 2. Radio frequency unit 201 receives a coded speech signal via an antenna 212. The received radio frequency signal is down converted to a baseband frequency and demodulated in the RF unit 201 to recover speech information. Generally, coded speech is further encoded prior to being transmitted to comprise channel coding and error correction coding. This channel coding and error correction coding has to be decoded at the receiver before the speech coding can be accessed or recovered. Speech coding parameters are recovered by parameter decoder 202.

The speech coding parameters in LPC speech coding are the set of LPC synthesis filter coefficients r(i); i=1 . . . , m, (where m is the order of the prediction), fixed code book index i and gain g. The adaptive code book speech coding parameters delay T and gain b are also recovered.

The speech decoder 200 utilises the above mentioned speech coding parameters to create from the excitation generator 211 an excitation signal ex(n) for inputting to the LPC synthesis filter 208 which provides a synthesised speech frame signal s(n) at its output as a response to the excitation signal ex(n). The synthesised speech frame signal s(n) is further processed in audio processing unit 209 and rendered audible through an appropriate audio transducer 210.

In typical linear predictive speech decoders, the excitation signal ex(n) for the LPC synthesis filter 208 is formed in excitation generator 211 comprising a fixed code book 203 generating excitation sequence $c_i(n)$ and adaptive code book 204. The location of the code book excitation sequence ex(n) in the respective code books 203, 204 is indicated by the speech coding parameter i and delay T. The fixed code book excitation sequence $c_i(n)$ partially used to form the excitation signal ex(n) is taken from the fixed excitation code book 203 from a location indicated by index i and is then suitably scaled by the transmitted gain factor g in the scaling unit 205. Similarly, the adaptive code book excitation sequence v(n) also partially used to form excitation signal ex(n) is taken from the adaptive code book 204 from a location indicated by delay T using selection logic inherent to the adaptive code book and is then suitably scaled by the transmitted gain factor b in scaling unit 206.

The adaptive code book 204 operates on the fixed code book excitation sequence $c_i(n)$ by adding a second partial excitation component v(n) to the code book excitation sequence g $c_i(n)$. The second component is derived from past excitation signals in a manner already described with reference to FIG. 1, and is selected from the adaptive code book 204 using selection logic suitably included in the adaptive code book. The component v(n) is suitably scaled in the scaling unit 206 by the transmitted adaptive code book gain b and then added to g $c_i(n)$ in the adder 207 to form the total excitation signal ex(n), where $$ex(n)=g\ c_i(n)+b\ v(n). \tag{1}$$

The adaptive code book 204 is then updated by using the total excitation signal ex(n).

The location of the second partial excitation component v(n) in the adaptive code book 204 is indicated by the speech coding parameter T. The adaptive excitation component is selected from the adaptive code book using speech coding parameter T and selection logic included in the adaptive code book.

Figure 3:
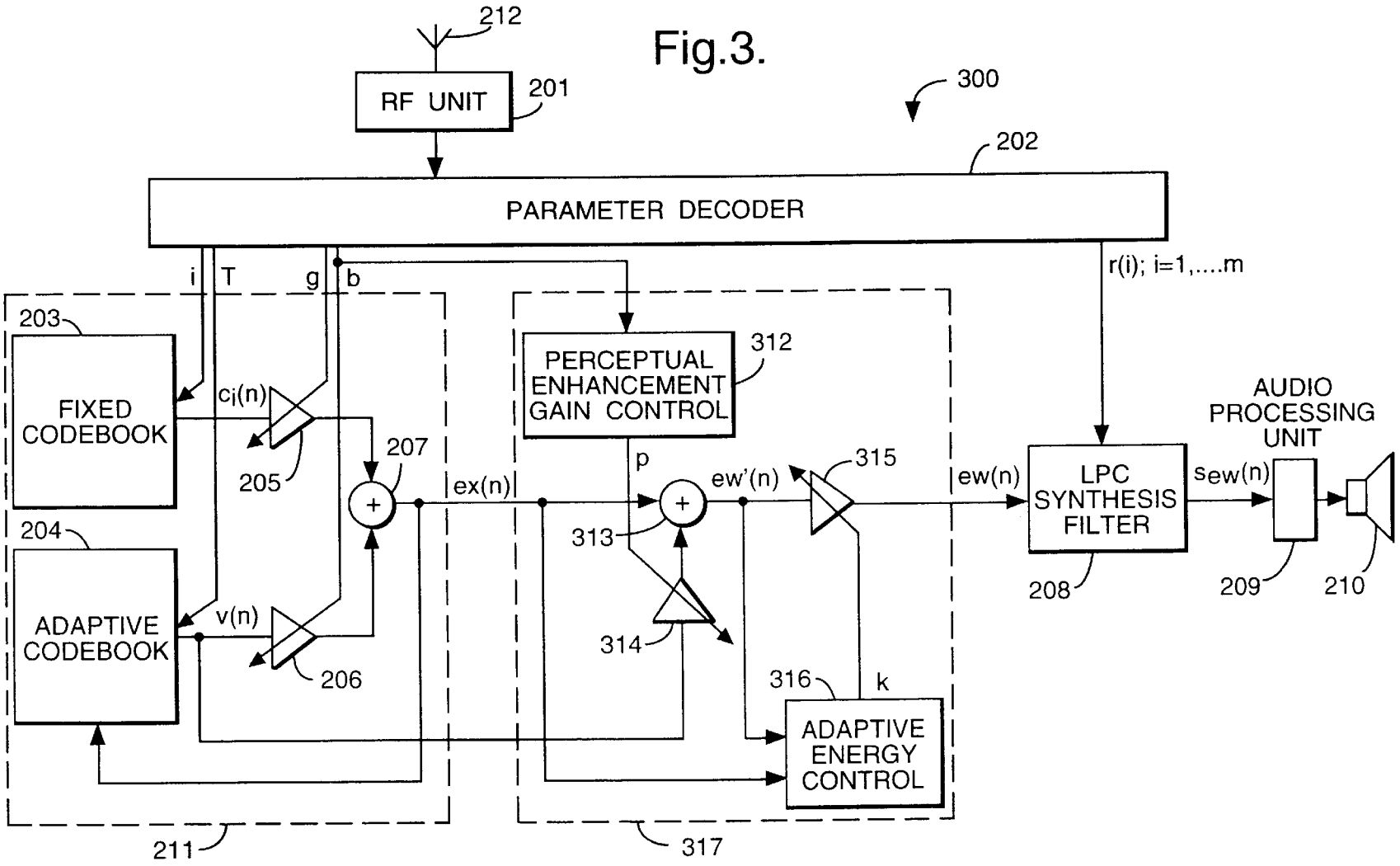
FIG. 3 shows a schematic diagram of a CELP decoder in accordance with a first embodiment of the invention.

An LPC speech synthesis decoder 300 in accordance with the invention is shown in FIG. 3. The operation of speech synthesis according to FIG. 3 is the same as for FIG. 2 except that the total excitation signal ex(n) is, prior to being used as the excitation for the LPC synthesis filter 208, processed in excitation post-processing unit 317. The operation of circuit elements 201 to 212 in FIG. 3 are similar to those in FIG. 2 with the same numerals.

In accordance with an aspect of the invention, a post-processing unit 317 for the total excitation ex(n) is used in the speech decoder 300. The post-processing unit 317 comprises an adder 313 for adding a third component to the total excitation ex(n). A gain unit 315 then appropriately scales the resulting signal ew'(n) to form signal ew(n) which is then used to excite the LPC synthesis filter 208 to produce synthesised speech signal $s_{ew}(n)$. The speech synthesised according to the invention has improved perceptual quality compared to the speech signal s(n) synthesised by the prior art speech synthesis decoder shown in FIG. 2.

The post-processing unit 317 has the total excitation ex(n) input to it, and outputs a perceptually enhanced total excitation ew(n). The post-processing unit 317 also has the adaptive code book gain b, and an unscaled partial excitation component v(n) taken from the adaptive code book 204 at a location indicated by the speech coding parameters as further inputs. Partial excitation component v(n) is suitably the same component which is employed inside the excitation generator 211 to form the second excitation component by(n) which is added to the scaled code book excitation $gc_i(n)$ to form the total excitation ex(n). By using an excitation sequence which is derived from the adaptive code book 204, no further sources of artifacts are added to the speech processing electronics, as is the case with the known post or pre-filter techniques which use extra filters. The excitation post-processing unit 317 also comprises scaling unit 314 which scales the partial excitation component v(n)by a scale factor p, and the scaled component pv(n) is added by adder 313 to the total excitation component ex(n). The output of adder 313 is an intermediate total excitation signal ew'(n). It is of the form, $$\begin{aligned} ew'(n) &= gc_i(n) + bv(n) + pv(n) \\ &= gc_i(n) + (b+p)v(n). \end{aligned} \tag{2}$$

The scaling factor p for scaling unit 314 is determined in the perceptual enhancement gain control unit 312 using the adaptive code book gain b. The scaling factor p re-scales the contribution of the two excitation components from the fixed and adaptive code book, $c_i(n)$ and v(n), respectively. The scaling factor p is adjusted so that during synthesised speech frame samples that have high adaptive code book gain value b the scale factor p is increased, and during speech that has low adaptive code book gain value b the scaling factor p is reduced. Furthermore, when b is less than a threshold value ($b<TH_{low}$) the scaling factor p is set to zero. The perceptual enhancement gain control unit 312 operates in accordance with equation (3) given below, $$\text{if}\quad \begin{array}{ll} b < TH_{low} & \text{then } p = 0.0 \\ TH_{low} \le b \le TH_{upper} & \text{then } p = a_{enh} b^2 \\ b > TH_{upper} & \text{then } p = a_{enh} b \end{array} \tag{3}$$

where $a_{enh}$ is a constant that controls the strength of the enhancement operation. The applicant has found that a good value for $a_{enh}$ is 0.25, and good values for $TH_{low}$ and $TH_{upper}$ are 0.5 and 1.0, respectively.

Equation 3 can be of a more general form, and a general formulation of the enhancement function is shown below in equation (4). In the general case, there could be more than 2 thresholds for the enhancement gain b. Also, the gain could be defined as a more general function of b.

$$\text{if}\quad \begin{array}{ll} b < TH_{low} & \text{then } p = 0.0 \\ TH_{low} \le b < TH_2 & \text{then } p = a_{enh1} f_1(b) \\ TH_2 \le b < TH_3 & \text{then } p = a_{enh2} f_2(b) \\ \vdots & \vdots \\ TH_{N-1} \le b \le TH_{upper} & \text{then } p = a_{enhN-1} f_{N-1}(b) \\ b > TH_{upper} & \text{then } p = a_{enhN} f_N(b) \end{array} \tag{4}$$

In the preferred embodiment previously described N=2, $TH_{low}=0.5$, $TH_2=1.0$, $TH3=\infty a_{enh1}=0.25$, and $a_{enh2}=0.25$, $f_1(b)=b^2$, and $f_2(b)=b$.

The threshold values (TH), enhancement values ($a_{enh}$) and the gain functions (f(b)) are arrived at empirically. Since the only realistic measure of perceptual speech quality can be obtained by human beings listening to the speech and giving their subjective opinions on the speech quality, the values used in equations (3) and (4) are determined experimentally. Various values for the enhancement thresholds and gain functions are tried, and those resulting in the best sounding speech are selected. The applicant has utilised the insight that the enhancement to the speech quality using this method is particularly effective for voiced speech where b typically has a high value, whereas for less voiced sounds which have a lower value of b not so strong an enhancement is required. Thus, gain value p is controlled such that for voiced sounds, where the distortions are most audible, the effect is strong and for unvoiced sounds the effect is weaker or not used at all. Thus, as a general rule, the gain functions ($f_n$) should be chosen so that there is a greater effect for higher values of b, than for lower values of b. This increases the difference between the pitch components of the speech and the other components.

In the preferred embodiment, operating in accordance with equation (3), the functions operating on gain value b are a squared dependency for mid-range values of b and a linear dependency for high-range values of b. It is the applicant's present understanding that this gives good speech quality since for high values of b, i.e. highly voiced speech, there is greater effect and for lower values of b there is less effect. This is because b typically lies in the range $-1<b<1$ and therefore $b^2<b$.

To ensure unity power gain between the input signal ex(n), and the output signal ew(n) of the excitation post-processing unit 317, a scale factor is computed and is used to scale the intermediate excitation signal ew'(n) in the scaling unit 315 to form the post-processed excitation signal ew(n). The scale factor k is given as $$k = \sqrt{\frac{\sum_{n=0}^{N-1} ex^2(n)}{\sum_{n=0}^{N-1} ew'^2(n)}} \tag{5}$$

where N is a suitably chosen adaption period. Typically, N is set equal to the excitation frame length of the LPC speech codec.

In the adaptive code book of the encoder, for values of T which are less than the frame length or excitation length a part of the excitation sequence is unknown. For these unknown portions a replacement sequence is locally generated within the adaptive code book by using suitable selection logic. Several adaptive code book techniques to generate this replacement sequence are known from the state of the art. Typically, a copy of a portion of the known excitation is copied to where the unknown portion is located thereby creating a complete excitation sequence. The copied portion may be adapted in some manner to improve the quality of the resulting speech signal. When doing such copying, the delay value T is not used since it would point to the unknown portion. Instead, a particular selection logic resulting in a modified value for T is used (for example, using T multiplied by an integer factor so that it always points to the known signal portion). So that the decoder is synchronised with the encoder, similar modifications are employed in the adaptive code book of the decoder. By using such a selection logic to generate a replacement sequence within the adaptive code book, the adaptive code book is able to adapt for high pitch voices such as female and child voices resulting in efficient excitation generation and improved speech quality for these voices.

For obtaining good perceptual enhancement, all modifications inherent to the adaptive code book e.g. for values of T less than the frame length are taken into account in the enhancement post-processing. This is obtained in accordance with the invention by the use of the partial excitation sequence from the adaptive code book v(n) and the re-scaling of the excitation components, inherent to the excitation generator of the speech synthesiser.

In summary, the method enhances the perceptual quality of the synthesised speech and reduces audible artifacts by adaptively scaling the contribution of the partial excitation components taken from the code book 203 and from the adaptive code book 204, in accordance with equations (2), (3), (4) and (5).

Figure 4:
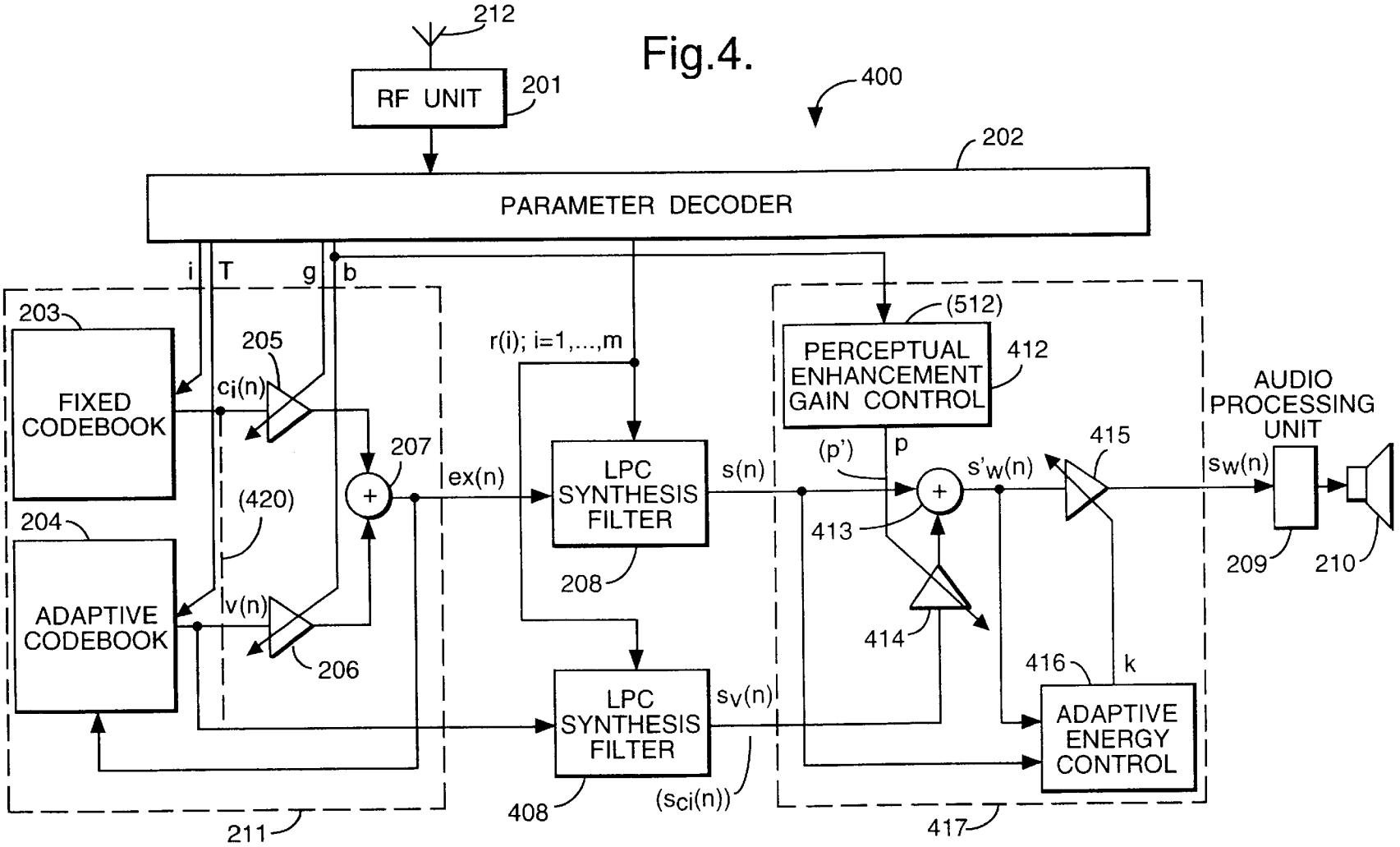
FIG. 4 shows a second embodiment in accordance with the invention.

FIG. 4 shows a second embodiment in accordance with the invention, wherein the excitation post-processing unit 417 is located after the LPC synthesis filter 208 as illustrated. In this embodiment an additional LPC synthesis filter 408 is required for the third excitation component derived from the adaptive code book 204. In FIG. 4, elements which have the same function as in FIGS. 2 and 3, also have the same reference numerals.

In the second embodiment shown in FIG. 4, the LPC synthesised speech is perceptually enhanced by post-processor 417. The total excitation signal ex(n) derived from the code book 203 and adaptive code book 204 is input to LPC synthesis filter 208 and processed in a conventional manner in accordance with the LPC coefficients r(i). The additional or third partial excitation component v(n) derived from the adaptive code book 204 in the manner described in relation to FIG. 3 is input unscaled to a second LPC synthesis filter 408 and processed in accordance with the LPC coefficients r(i). The outputs s(n) and $s_v(n)$ of respective LPC filters 208, 408 are input to post-processor 417 and added together in adder 413. Prior to being input to adder 413, signal $s_v(n)$ is scaled by scale factor p. As described with reference to FIG. 3, the values for processing scale factor or gain p can be arrived at empirically. Additionally, the third partial excitation component may be derived from the fixed code book 203 and the scaled speech signal $p's_v(n)$ subtracted from speech signal s(n).

The resulting perceptually enhanced output $s_w(n)$ is then input to the audio processing unit 209.

Optionally, a further modification of the enhancement system can be formed by moving the scaling unit 414 of FIG. 4 to be in front of the LPC synthesis filter 408. Locating the post-processor 417 after the LPC or short term synthesis filters 208, 408 can give better control of the emphasis of the speech signal since it is carried out directly on the speech signal, not on the excitation signal. Thus, less distortions are likely to occur.

Optionally, enhancement can be achieved by modifying the embodiments described with reference to FIGS. 3 and 4 respectively, such that the additional (third) excitation component is derived from the fixed code book 203 instead of the adaptive code book 204. Then, a negative scaling factor should be used instead of the original positive gain factor p, to decrease the gain for excitation sequence $c_i(n)$ from the fixed code book. This results in a similar modification of the relative contributions of the partial excitation signals $c_i(n)$ and v(n), to speech synthesis as achieved with the embodiments of FIGS. 3 and 4.

Figure 5:
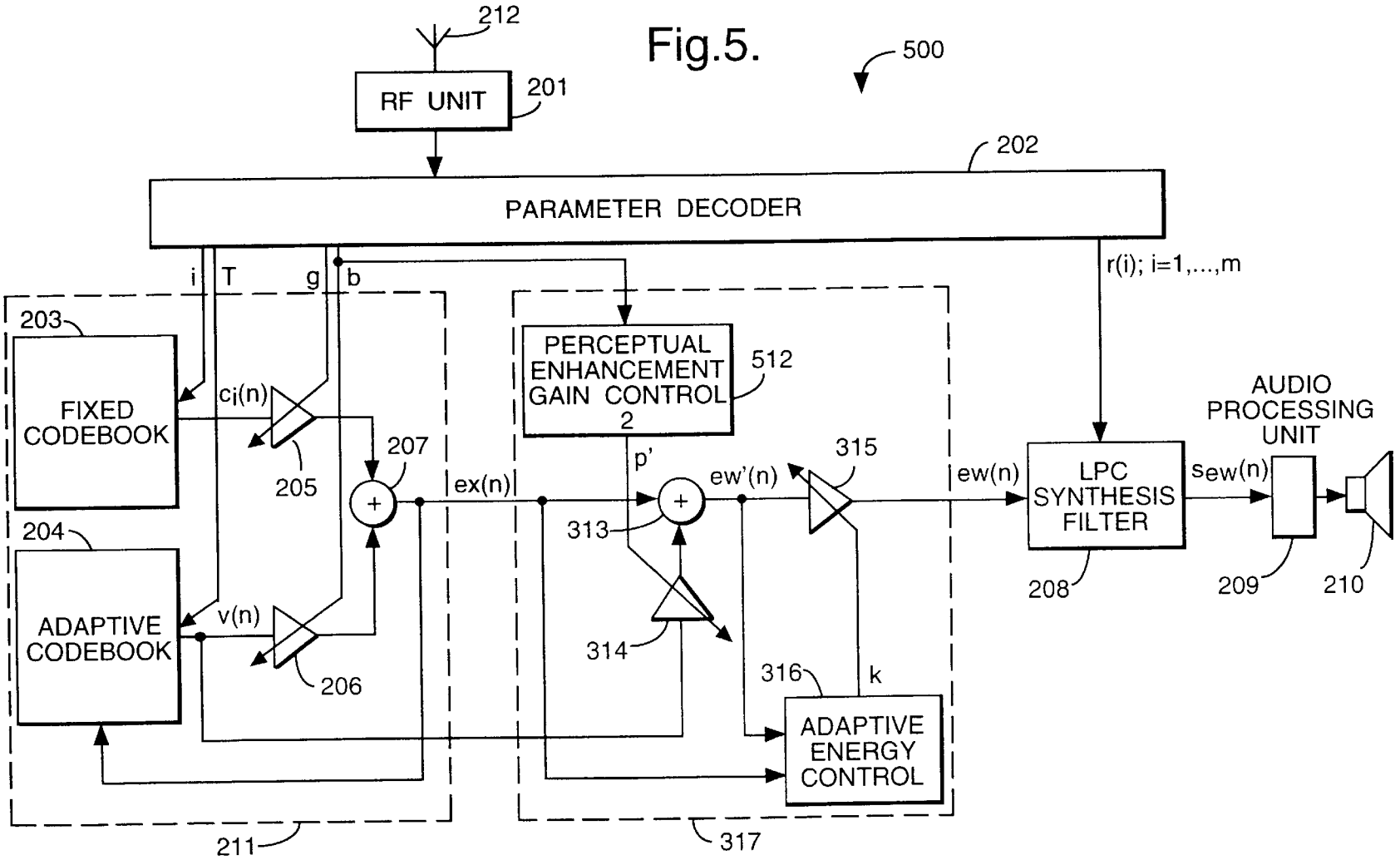
FIG. 5 shows a third embodiment in accordance with the invention.

FIG. 5 shows an embodiment in accordance with the invention in which the same result as obtained by using scaling factor p and the additional excitation component from the adaptive code book may be achieved. In this embodiment, the fixed code book excitation sequence $c_i(n)$ is input to scaling unit 314 which operates in accordance with scale factor p' output from perceptual enhancement gain control 2 512. The scaled fixed code book excitation, $p'c_i(n)$, output from scaling unit 314 is input to adder 313 where it is added to total excitation sequence ex(n) comprising components $c_i(n)$ and v(n) from the fixed code book 203 and adaptive code book 204 respectively.

When increasing the gain for the excitation sequence signal v(n) from the adaptive code book 204 the total excitation (before adaptive energy control 316) is given by equation (2), viz.

$$ew'(n)=g\ c_i(n)+(b+p)v(n) \tag{2}$$

When decreasing the gain for an excitation sequence $c_i(n)$ from the fixed code book 203, the total excitation (before adaptive energy control 316) is given as $$ew'(n)=(g+p')\ c_i(n)+bv(n) \tag{6}$$

where p' is the scaling factor derived by perceptual enhancement gain control 2 512 shown in FIG. 5. Taking equation (2) and reformulating it into a form similar to equation (6) gives:

$$ew'(n)=g\ c_i(n)+(b+p)v(n)$$

$$= \frac{p+b}{b}\left[\left(\frac{gb}{p+b}\right)c_i(n) + bv(n)\right]$$

$$= \frac{p+b}{b}\left[\left(g - \frac{gp}{p+b}\right)c_i(n) + bv(n)\right]$$

Thus, selecting $$p' = -\frac{gp}{(p+b)}$$

In the embodiment of FIG. 5 a similar enhancement as obtained with the embodiment of FIG. 3 will be achieved. When the intermediate total excitation signal ew'(n) is scaled by adaptive energy control 316 to the same energy content as ex (n), then both embodiments, FIG. 3 and FIG. 5 result in the same total excitation signal ew(n).

Perceptual enhancement gain control 2 512 can therefore utilise the same processing as employed in relation to the embodiments of FIGS. 3 and 4 to generate "p", and then utilise equation (8) to get p'.

The intermediate total excitation signal ew'(n) output from adder 313 is scaled in scaling unit 315 under control of adaptive energy control 316 in a similar manner as described above in relation to the first and second embodiments.

Referring now to FIG. 4, LPC synthesised speech may be perceptually enhanced by post-processor 417 by synthesised speech derived from additional excitation signals from the fixed code book.

The dotted line 420 in FIG. 4 shows an embodiment wherein the fixed code book excitation signals $c_i(n)$ are coupled to LPC synthesis filter 408. The output of the LPC synthesis filter 408 ($sc_i(n)$) is then scaled in unit 414 in accordance with scaling factor p' derived from perceptual enhancement gain control 512, and added to the synthesised signal s(n) in adder 413 to produce intermediate synthesis signal $s'_w(n)$. After normalisation in scaling unit 415 the resulting synthesis signal $s_w(n)$ is forwarded to the audio processing unit 209.

The foregoing embodiments comprise adding a component derived from the adaptive code book 204 or fixed code book 203 to an excitation ex(n) or synthesised s(n), to form an intermediate excitation ew'(n) or synthesised signal $s'_w(n)$.

Optionally, post-processing may be dispensed with and the adaptive code book v(n) or fixed code book $c_i(n)$ excitation signals may be scaled and directly combined together. Thereby obviating the addition of components to unscaled combined fixed and adaptive code book signals.

Figure 6:
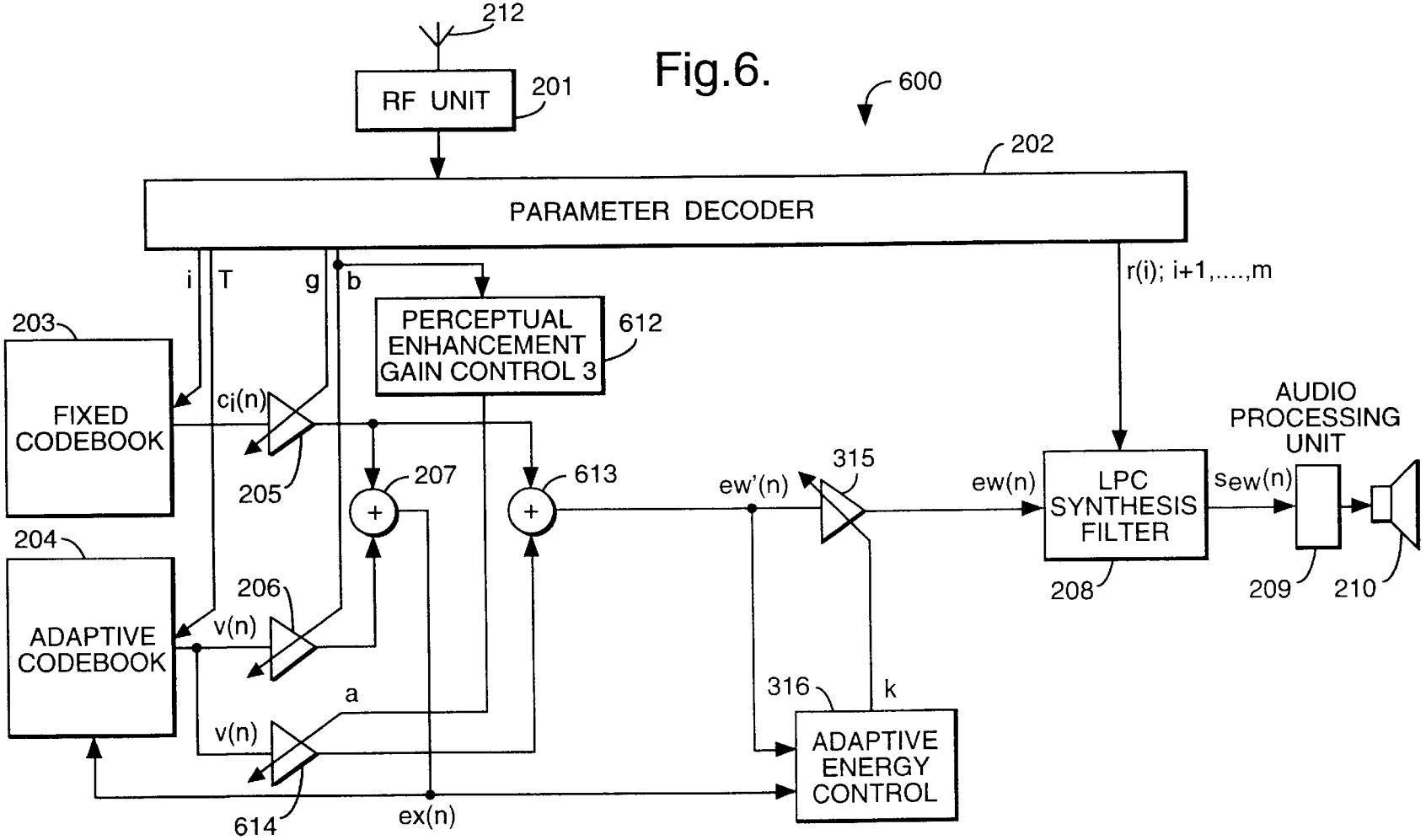
FIG. 6 shows a fourth embodiment in accordance with the invention.

FIG. 6 shows an embodiment in accordance with an aspect of the invention having the adaptive code book excitation signals v(n) scaled and then combined with the fixed code book excitation signals $c_i(n)$ to directly form an intermediate signal ew'(n).

Perceptual enhancement gain control 612 outputs parameter "a" to control scaling unit 614. Scaling unit 614 operates on adaptive code book excitation signal v(n) to scale-up or amplify excitation signal v(n) over the gain factor b used to get the normal excitation. Normal excitation ex(n) is also formed and coupled to the adaptive code book 204 and adaptive energy control 316. Adder 613 combines up-scaled excitation signal av(n) and fixed code book excitation $c_i(n)$ to form an intermediate signal;

$$ew'(n) = g\ c_i(n) + av(n) \tag{9}$$

If a=b+p, then the same processing as given by equation (2) may be achieved.

Figure 7:
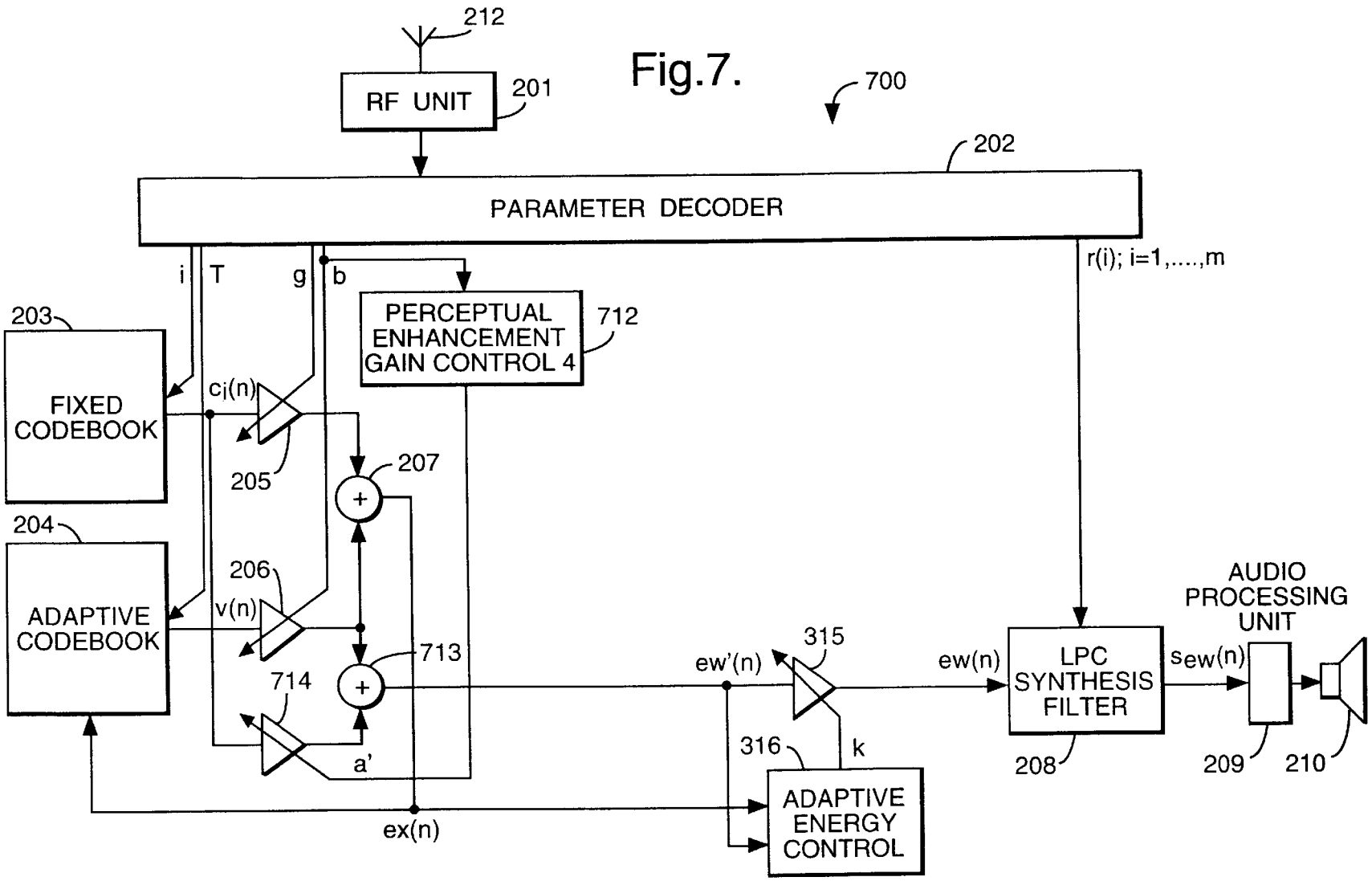
FIG. 7 shows a fifth embodiment in accordance with the invention.

FIG. 7 shows an embodiment operable in a manner similar to that shown in FIG. 6, but down-scaling or attenuating the fixed code book excitation signal $c_i(n)$. For this embodiment the intermediate excitation sign ew'(n) is given by:

$$ew'(n) = (g + p')c_i(n) + bv(n) \tag{10}$$

$$= a'c_i(n) + bv(n),$$

where, $$a' = g - \frac{gp}{p+b} = \frac{gb}{p+b}. \tag{11}$$

Perceptual enhancement gain control 712 outputs a control signal a' in accordance with equation (11), to obtain a similar result as obtained with equation (6) in accordance with equation (8). The down-scaled fixed code book excitation signal $a'c_i(n)$ is combined with adaptive code book excitation signal v(n) in adder 713 to form intermediate excitation signal ew'(n). The remaining processing is carried out as described before, to normalise the excitation signal and formed synthesised signal $s_{ew}(n)$.

The embodiments described with reference to FIGS. 6 and 7 perform scaling of the excitation signals within the excitation generator, and directly from the code books.

The determination of scaling factor "p" for the embodiments described with reference to FIGS. 5, 6 and 7 may be made in accordance with equations (3) or (4) described above.

Various methods of control of the enhancement level ($a_{enh}$) may be employed. In addition to the adaptive code book gain b, the amount of enhancement could be a function of the lag or delay value T for the adaptive code book 204. For example, the post processing could be turned on (or emphasised) when operating in a high pitch range or when the adaptive code book parameter T is shorter than the excitation block length (virtual lag range). As a result, female and child voices for which the invention is most beneficial, would be highly post processed.

The post processing control could also be based on voiced/unvoiced speech decisions. For example, the enhancement could be stronger for voiced speech, and it could be totally turned off when the speech is classified as unvoiced. This can be derived from the adaptive code book gain value b which is itself a simple measure of voiced/unvoiced speech, that is to say the higher b, the more voiced speech present in the original speech signal.

Embodiments in accordance with the present invention may be modified, such that the third partial excitation sequence is not the same partial excitation sequence derived from the adaptive code book or fixed code book in accordance with conventional speech synthesis, but is selectable via selection logic typically included in respective code books to choose another third partial excitation sequence. The third partial excitation sequence may be chosen to be the immediately previously used excitation sequence or to be always a same excitation sequence stored in the fixed code book. This would act to reduce the difference between speech frames and thereby enhance the continuity of the speech. Optionally, b and/or T can be recalculated in the decoder from the synthesised speech and used to derive a third partial excitation sequence. Further, a fixed gain p and/or fixed excitation sequence can be added or subtracted as appropriate to the total excitation sequence ex(n) or speech signal s(n) depending on the location of the post-processor.

In view of the foregoing description it will be evident to a person skilled in the art that various modifications may be made within the scope of the invention. For example, variable-frame-rate coding, fast code book searching, reversal of the order of pitch prediction and LPC prediction may be utilised in the codec. Additionally, post-processing in accordance with the present invention could also be included in the encoder, not just the decoder. Furthermore, aspects of respective embodiments described with reference to the drawings may be combined to provide further embodiments in accordance with the invention.

The scope of the present disclosure includes any novel feature or combination of features disclosed therein either explicitly or implicitly or any generalisation thereof irrespective of whether or not it relates to the claimed invention or mitigates any or all of the problems addressed by the present invention. The applicant hereby gives notice that new claims may be formulated to such features during prosecution of this application or of any such further application derived therefrom.

What we claim is:

1. A synthesiser for speech synthesis, comprising:

an excitation source; and a post-processing means coupled to said excitation source for operating on a first signal including speech periodicity information derived from said excitation source, wherein the post-processing means modifies the speech periodicity information content of the first signal in accordance with a second signal derivable from said excitation source in order to produce an enhanced synthesised speech signal;

wherein the post-processing means comprises gain control means for scaling the second signal in accordance with a first scaling factor (p) derivable from pitch information associated with the first signal;

wherein the excitation source comprises a fixed code book and an adaptive code book, the first signal comprising a combination of first and second partial excitation signals respectively originating from the fixed and adaptive code books, the second signal being substantially the same as the second partial excitation signal and originating from the adaptive code book, the first signal being modified by combining the second signal with the first signal, and the first scaling factor (p) being derivable from an adaptive code book gain factor (b) in accordance with the following relationship, $$\text{if}\quad \begin{array}{ll} b < TH_{low} & \text{then } p = 0.0 \\ TH_{low} \le b < TH_2 & \text{then } p = a_{enh1} f_1(b) \\ TH_2 \le b < TH_3 & \text{then } p = a_{enh2} f_2(b) \\ \vdots & \vdots \\ TH_{N-1} \le b \le TH_{upper} & \text{then } p = a_{enhN-1} f_{N-1}(b) \\ b > TH_{upper} & \text{then } p = a_{enhN} f_N(b) \end{array}$$

where TH represents threshold values, b is the adaptive code book gain factor, p is the first post-processing means scale factor, $a_{enh}$ is a linear scaler and f(b) is a function of the adaptive code book gain factor b, and wherein the post-processing means further comprises an adaptive energy control means adapted to scale a modified first signal in accordance with the following relationship, $$k = \sqrt{\frac{\sum_{n=0}^{N-1} ex^2(n)}{\sum_{n=0}^{N-1} ew'^2(n)}}$$

where N is a suitably chosen adaption period, ex(n) is the first signal, ew' (n) is a modified first signal and k is an energy scale factor.

2. A synthesiser for speech synthesis, comprising:

an excitation source; and a post-processing means coupled to said excitation source for operating on a first signal including speech periodicity information derived from said excitation source, wherein the post-processing means modifies the speech periodicity information content of the first signal in accordance with a second signal derivable from said excitation source in order to produce an enhanced synthesised speech signal;

wherein the post-processing means comprises gain control means for scaling the second signal in accordance with a first scaling factor (p) derivable from pitch information associated with the first signal;

wherein the excitation source comprises a fixed code book and an adaptive code book, the first signal comprising a combination of first and second partial excitation signals respectively originating from the fixed and adaptive code books, the second signal being substantially the same as the first impartial excitation signal and originating from the fixed code book, the first signal being modified by combining the second signal with the first signal, and the first scaling factor (p) being derivable from an adaptive code book gain factor (b) in accordance with the following relationship, $$\text{if}\quad \begin{array}{ll} b < TH_{low} & \text{then } p = 0.0 \\ TH_{low} \le b < TH_2 & \text{then } p = a_{enh1} f_1(b) \\ TH_2 \le b < TH_3 & \text{then } p = a_{enh2} f_2(b) \\ \vdots & \vdots \\ TH_{N-1} \le b \le TH_{upper} & \text{then } p = a_{enhN-1} f_{N-1}(b) \\ b > TH_{upper} & \text{then } p = a_{enhN} f_N(b) \end{array}$$

where TH represents threshold values, b is the adaptive code book gain factor, p is the first post-processing means scale factor, $a_{enh}$ is a linear scaler and f(b) is a function of the adaptive code book gain factor b, and wherein the post-processing means further comprises an adaptive energy control means adapted to scale a modified first signal in accordance with the following relationship, $$k = \sqrt{\frac{\sum_{n=0}^{N-1} ex^2(n)}{\sum_{n=0}^{N-1} ew'^2(n)}}$$

where N is a suitably chosen adaption period, ex(n) is the first signal, ew' (n) is a modified first signal and k is an energy scale factor.

3. A method for enhancing synthesised speech, comprising steps of:

deriving a first signal including speech periodicity information from an excitation source, deriving a second signal from the excitation source, and modifying the speech perodicity information content of the first signal in accordance with the second signal in order to produce an enhanced synthesised speech signal;

the method further comprising, scaling the second signal in accordance with a first scaling factor (p) derived from pitch information associated with the first signal;

wherein the excitation source comprises a fixed code book and an adaptive code book, the first signal comprising a combination of first and second partial excitation signals respectively originating from the fixed and adaptive code books;

wherein the first scaling factor (p) is derivable from a gain factor (b) for, the pitch information of the first signal; and wherein the scaling factor (p) is derivable in accordance with $$\text{if}\quad \begin{array}{ll} b < TH_{low} & \text{then } p = 0.0 \\ TH_{low} \le b \le TH_{upper} & \text{then } p = a_{enh} b^2 \\ b > TH_{upper} & \text{then } p = a_{enh} b \end{array}$$

where $a_{enh}$ is a constant that controls the strength of the enhancement operation, b is the gain factor for the pitch information of the first signal, TH are threshold values and p is the first scaling factor.

4. A method for enhancing synthesised speech, comprising steps of:

deriving a first signal including speech periodicity information from an excitation source, comprising a fixed code book and an adaptive code book, the first signal comprising a combination of first and second partial excitation signals respectively originating from the fixed and adaptive code books, deriving a second signal from the excitation source, and modifying the speech periodicity information content of the first signal in accordance with the second signal in order to produce an enhanced synthesised speech signal, the second signal being substantially the same as the second partial excitation signal and originating from the adaptive code book, the first signal being modified by combining the second signal with the first signal, and a first scaling factor (p) being derivable from an adaptive code book scaling factor (b) in accordance with the following relationship, $$\text{if}\quad \begin{array}{ll} b < TH_{low} & \text{then } p = 0.0 \\ TH_{low} \le b < TH_2 & \text{then } p = a_{enh1} f_1(b) \\ TH_2 \le b < TH_3 & \text{then } p = a_{enh2} f_2(b) \\ \vdots & \vdots \\ TH_{N-1} \le b \le TH_{upper} & \text{then } p = a_{enhN-1} f_{N-1}(b) \\ b > TH_{upper} & \text{then } p = a_{enhN} f_N(b) \end{array}$$

where TH represents threshold values, $a_{enh}$ is a linear scaler and f(b) is a function of b, wherein the modified first signal is normalised in accordance with the following relationship, $$k = \sqrt{\frac{\sum_{n=0}^{N-1} ex^2(n)}{\sum_{n=0}^{N-1} ew'^2(n)}}$$

where N is a suitably chosen adaption period, ex(n) is the first signal, ew'(n) is a modified first signal and k is an energy scale factor.

5. A method for enhancing synthesised speech, comprising steps of:

deriving a first signal including speech periodicity information from an excitation source, comprising a fixed code book and an adaptive code book, the first signal comprising a combination of first and second partial excitation signals respectively originating from the fixed and adaptive code books, deriving a second signal from the excitation source, and modifying the speech periodicity information content of the first signal in accordance with the second signal in order to produce an enhanced synthesised speech signal, the second signal being substantially the same as the first partial excitation signal and originating from the fixed code book, the first signal being modified by combining the second signal with the first signal, and a first scaling factor (p) being derivable from an adaptive code book scaling factor (b) in accordance with the following relationship, $$\text{if}\quad \begin{array}{ll} b < TH_{low} & \text{then } p = 0.0 \\ TH_{low} \le b < TH_2 & \text{then } p = a_{enh1} f_1(b) \\ TH_2 \le b < TH_3 & \text{then } p = a_{enh2} f_2(b) \\ \vdots & \vdots \\ TH_{N-1} \le b \le TH_{upper} & \text{then } p = a_{enhN-1} f_{N-1}(b) \\ b > TH_{upper} & \text{then } p = a_{enhN} f_N(b) \end{array}$$

where TH represents threshold values, $a_{enh}$ is a linear scaler and f(b) is a function of b, wherein the modified first signal is normalised in accordance with the following relationship, $$k = \sqrt{\frac{\sum_{n=0}^{N-1} ex^2(n)}{\sum_{n=0}^{N-1} ew'^2(n)}}$$

where N is a suitably chosen adaption period, ex(n) is the first signal, ew' (n) is a modified first signal and k is an energy scale factor.

6. A synthesiser for speech synthesis, comprising first and second excitation sources for respectively generating first and second excitation signals, and modifying means for modifying the second excitation signal in accordance with a scaling factor derivable from pitch information associated with the first excitation signal in order to produce an enhanced synthesised speech signal, wherein the modifying means scales the second excitation signal in accordance with a scaling factor (a') derivable from pitch information associated with the first signal, wherein the first excitation source is an adaptive code book and the second equitation source is a fixed code book, and wherein the scaling factor (a') satisfies the following relationship;

$$a' = -\frac{gp}{(p+b)}$$

where g is a fixed code book gain factor, b is an adaptive code gain factor and p is a perceptual enhancement gain factor, wherein the perceptual enhancement gain factor p is derivable in accordance with;

$$\text{if} \quad \begin{array}{ll} b < TH_{low} & \text{then } p = 0.0 \\ TH_{low} \le b \le TH_{upper} & \text{then } p = a_{enh} b^2 \\ b > TH_{upper} & \text{then } p = a_{enh} b \end{array}$$

where $a_{enh}$ is a constant that controls the strength of the enhancement operation and TH are threshold values.

7. A synthesiser according to claim 6, wherein the first and second excitation signals are combined after modification.

8. A synthesiser for speech synthesis, comprising first and second excitation sources for respectively generating first and second excitation signals, and modifying means for modifying the first excitation signal in accordance with a scaling factor derivable from pitch information associated with the first excitation signal in order to produce an enhanced synthesised speech signal, wherein the modifying means scales the first excitation signal in accordance with a scaling factor (a) derivable from pitch information associated with the first signal, wherein the first excitation source is an adaptive code book and the second excitation source is a fixed code book, wherein the scaling factor (a) is of the form a=b+p, where b is an adaptive code book gain and p is a perceptual enhancement gain factor derivable in accordance with the following relationships;

$$\text{if} \quad \begin{array}{ll} b < TH_{low} & \text{then } p = 0.0 \\ TH_{low} \le b < TH_2 & \text{then } p = a_{enh1} f_1(b) \\ TH_2 \le b < TH_3 & \text{then } p = a_{enh2} f_2(b) \\ \vdots & \vdots \\ TH_{N-1} \le b \le TH_{upper} & \text{then } p = a_{enhN-1} f_{N-1}(b) \\ b > TH_{upper} & \text{then } p = a_{enhN} f_N(b) \end{array}$$

where TH represents threshold values, $a_{enh}$ is a linear scaler and f(b) is a function of gain b, wherein the first and second excitation signals are combined after modification, and further comprising an adaptive energy control means for modifying combined scaled first and second signals in accordance with the following relationship;

$$k = \sqrt{\frac{\sum_{n=0}^{N-1} ex^2(n)}{\sum_{n=0}^{N-1} ew'^2(n)}}$$

where N is a suitable adaption period, ex(n) is the combined first and second signals, ew' (n) is the combined scaled first and second signals and K is an energy scale factor.

9. A synthesiser for speech synthesis, comprising first and second excitation sources for respectively generating first and second excitation signals, and modifying means for modifying the second excitation signal in accordance with a scaling factor derivable from pitch information associated with the first excitation signal in order to produce an enhanced synthesised speech signal, wherein the modifying means scales the second excitation signal in accordance with a scaling factor (a') derivable from pitch information associated with the first signal, wherein the first excitation source is an adaptive code book and the second excitation source is a fixed code book, wherein the scaling factor (a') satisfies the following relationship;

$$a' = -\frac{gp}{(p+b)}$$

where g is a fixed code book gain factor, b is an adaptive code gain factor and p is a perceptual enhancement gain factor, wherein the perceptual enhancement gain factor p is derivable in accordance with;

$$\text{if} \quad \begin{array}{ll} b < TH_{low} & \text{then } p = 0.0 \\ TH_{low} \le b \le TH_{upper} & \text{then } p = a_{enh} b^2 \\ b > TH_{upper} & \text{then } p = a_{enh} b \end{array}$$

where $a_{enh}$ is a constant that controls the strength of the enhancement operation and TH are threshold values, wherein the first and second excitation signals are combined after modification, and further comprising an adaptive energy control means for modifying combined scaled first and second signals in accordance with the following relationship;

$$k = \sqrt{\frac{\sum_{n=0}^{N-1} ex^2(n)}{\sum_{n=0}^{N-1} ex^{12}(n)}}$$

where N is a suitable adaption period, ex(n) is the combined first and second signals, ew' (n) is the combined scaled first and second signals and K is an energy scale factor.

10. A synthesiser for speech synthesis, comprising:

an excitation source; and a post-processing means coupled to said excitation source for operating on a first signal including speech periodicity information derived from said excitation source, wherein the post-processing means modifies the speech periodicity information content of the first signal in accordance with a second signal derivable from said excitation source in order to produce an enhanced synthesised speech signal;

wherein the post-processing means comprises gain control means for scaling the second signal in accordance with a first scaling factor (p) derivable from pitch information associated with the first signal;

wherein the excitation source comprises a fixed code book and an adaptive code book, the first signal comprising a combination of first and second partial excitation signals respectively originating from the fixed and adaptive code books;

wherein the first scaling factor (p) is derivable from an adaptive code book gain factor (b);

and wherein the scaling factor (p) is derivable in accordance with the relationships, $$\text{if}\quad \begin{array}{ll} b < TH_{low} & \text{then } p = 0.0 \\ TH_{low} \le b \le TH_{upper} & \text{then } p = a_{enh}b^2 \\ b > TH_{upper} & \text{then } p = a_{enh}b \end{array}$$

where $a_{enh}$ is a constant that controls the strength of the enhancement operation, b is the adaptive code book gain factor, TH are threshold values and p is the first post-processing means scale factor.

11. A synthesiser for speech synthesis, comprising:

first and second excitation sources for respectively generating first and second excitation signals, and modifying means for modifying the first excitation signal in accordance with a scaling factor derivable from pitch information associated with the first excitation signal in order to produce an enhanced synthesised speech signal, wherein the modifying means scales the first excitation signal in accordance with a scaling factor (a) derivable from pitch information associated with the first signal, wherein the first excitation source is an adaptive code book and the second excitation source is a fixed code book, wherein the scaling factor (a) is of the form a=b+p, where b is an adaptive code book gain and p is a perceptual enhancement gain factor, and wherein the perceptual enhancement gain factor p is derivable in accordance with the relationships;

$$\text{if}\quad \begin{array}{ll} b < TH_{low} & \text{then } p = 0.0 \\ TH_{low} \le b \le TH_{upper} & \text{then } p = a_{enh}b^2 \\ b > TH_{upper} & \text{then } p = a_{enh}b \end{array}$$

where $a_{enh}$ is a constant that controls the strength of the enhancement operation and TH are threshold values.

12. A synthesiser for speech synthesis, comprising;

an input unit for inputting a signal and for extracting coded information from said signal, the coded information comprising fixed codebook and adaptive codebook parameters, including an adaptive codebook gain factor;

an excitation source comprising a fixed codebook and an adaptive codebook and having inputs coupled to outputs of said input unit for receiving extracted coded information therefrom, said excitation source being responsive to the received extracted coded information for outputting a first partial excitation signal from said fixed codebook and a second partial excitation signal from said adaptive codebook, said excitation source further comprising means for combining said first and second partial excitation signals into a composite excitation signal; and a perceptual enhancement post-processor coupled to said excitation source for operating on said composite excitation signal by combining said composite excitation signal with a scaled version of said second partial excitation signal, wherein an amount of scaling of said second partial excitation signal is controlled by a scalincg factor having a value that is function of a value of said adaptive codebook gain factor;

wherein said scaling factor (p) is derived from said adaptive code book gain factor (b) in accordance with the relationships, $$\text{if}\quad \begin{array}{ll} b < TH_{low} & \text{then } p = 0.0 \\ TH_{low} \le b \le TH_{upper} & \text{then } p = a_{enh}b^2 \\ b > TH_{upper} & \text{then } p = a_{enh}b \end{array}$$

where $a_{enh}$ is a constant that controls a strength of perceptual enhancement and TH are threshold values.

* * * * *

UNITED STATES PATENT AND TRADEMARK OFFICE

CERTIFICATE OF CORRECTION

PATENT NO. : 6,029,128

DATED : 2/22/2000

INVENTOR(S) : Jarvinen et al.

It is certified that error appears in the above-identified patent and that said Letters Patent is hereby corrected as shown below:

On sheet one item [54] please correct the title to read: SPEECH SYNTHESISER

Signed and Sealed this

Eighth Day of May, 2001

*Attest:*

Nicholas P. Godici

NICHOLAS P. GODICI

*Attesting Officer*

*Acting Director of the United States Patent and Trademark Office*